United States Patent [19]

Hayes, Jr. et al.

[11] 4,134,931

[45] Jan. 16, 1979

[54] PROCESS FOR TREATMENT OF OLEFIN POLYMER FIBRILS

[75] Inventors: Dwight R. Hayes, Jr., Houston, Tex.; Richard R. Whitney, Sacramento, Calif.

[73] Assignee: Gulf Oil Corporation, Pittsburgh, Pa.

[21] Appl. No.: 887,163

[22] Filed: Mar. 16, 1978

[51] Int. Cl.[2] ..... C08L 29/04; C08L 23/04

[52] U.S. Cl. ..... 260/897 B; 162/146; 162/157 R; 162/182; 264/140; 264/23

[58] Field of Search ..... 162/157 R, 182; 260/897 B; 264/23

[56] References Cited

U.S. PATENT DOCUMENTS

| | | | |
|---|---|---|---|
| 3,904,804 | 9/1975 | Tabara et al. | 428/332 |
| 3,920,507 | 11/1975 | Yonemori | 162/157 R |
| 4,013,751 | 3/1977 | Davis et al. | 264/140 |
| 4,049,493 | 9/1977 | Lare | 162/157 R |
| 4,064,304 | 12/1977 | Fujita et al. | 428/207 |

*Primary Examiner*—Carman J. Seccuro

*Attorney, Agent, or Firm*—Richard L. Kelly

[57] ABSTRACT

A process is disclosed for treating high molecular weight olefin polymer fibrils in the presence of an aqueous solution of polyvinyl alcohol while subjecting the solution to ultrasonic vibrations.

4 Claims, No Drawings

PROCESS FOR TREATMENT OF OLEFIN POLYMER FIBRILS

BACKGROUND OF THE INVENTION

The manufacture of synthetic paper making fibers, commonly referred to as fibrils, by precipitating an olefin polymer from a hydrocarbon solution is known. A number of different processes are reported for manufacturing such fibrils and fibrils are offered for commercial sale in the United States by at least two suppliers. See U.S. Pat. No. 2,988,782; U.S. Pat. No. 3,740,493; and U.S. Pat. No. 4,013,751. Although fibrils made by different processes and/or obtained from different sources are essentially indistinguishable from each other by physical examination, it has been noted that waterlaid sheets prepared from different types of fibrils differ significantly from each other in important properties. These observed differences are believed to result from small differences in fibril structure which are difficult to detect by physical observation.

U.S. Pat. No. 4,049,493 discloses that a two-step process of first refining fibrils in the presence of a water miscible solvent such as isopropanol and then further refining such fibrils in an aqueous solution of a surfactant, including polyvinyl alcohol, improves the quality of waterlaid sheets prepared from such fibrils. Both refining steps are carried out under conditions of high shear stress as developed in a Waring Blendor. Fibrils prepared by this process have excellent properties. A limitation of the process, however, is the requirement that both refining steps be carried out under conditions of high shear stress.

SUMMARY OF THE INVENTION

The applicants have discovered that fibrils having properties equivalent to those obtained by the process of U.S. Pat. No. 4,049,493 can be obtained by a novel process that does not require refining under conditions of high shear stress. In the first step of the process, the fibrils as prepared and still wet with hydrocarbon solvent, are refined with a water miscible solvent such as isopropanol. The fibrils then are slurried in an aqueous solution of polyvinyl alcohol while subjecting the solution to ultrasonic vibrations.

DETAILED DESCRIPTION OF THE INVENTION

In the first step of the process, fibrils as prepared by a suitable process such as disclosed in U.S. Pat. No. 4,013,751 and wet with hydrocarbon solvent are refined with an organic liquid miscible with both the hydrocarbon solvent and water. Suitable organic liquids include, inter alia, alcohols such as methanol, isopropanol, etc., and ketones such as acetone, methyl ethyl ketone, etc. The refining should be carried under conditions of sufficient intensity and/or of sufficient time duration so that essentially all of the hydrocarbon solvent is displaced from the fibrils. On a laboratory scale, the refining can be carried out conveniently in a Waring Blendor. On a pilot plant or commercial scale, the refining is best carried out in a disc mill. The fibrils then are recovered by filtration or other recovery process to remove the maximum amount of the organic liquid used in the first refining step.

In the next step of the process, the fibrils are suspended and stirred in an aqueous solution of polyvinyl alcohol while subjecting the solution to ultrasonic vibrations. Typically the polyvinyl alcohol solution employed will have dissolved therein about 2 - 15 and preferably about 5 - 10 weight % of the polymer. The weight ratio of fibrils to polyvinyl alcohol solution employed will be such that a minimum of 1 and preferably at least 10 parts of polyvinyl alcohol are present per 100 parts of the fibrils. The grade of polyvinyl alcohol employed in the process is not critical. Vinol 540 sold by Air Products and Chemicals provides satisfactory results.

The required intensity of stirring in the second step of the process is quite low and needs to be sufficient only to freely suspend the fibrils in the aqueous medium. This feature of the present invention is a distinct advantage as compared with the requirements of the process disclosed in U.S. Pat. No. 4,049,493 which is energy intensive. In addition, the process of the invention does not require use of costly equipment needed to develop high shear stress in treating the fibrils with the polyvinyl alcohol solution.

The ultrasonic vibrations can be applied to the stirred solution by any suitable means with apparatus commercially available. It has been observed in general that the duration of the treatment is inversely proportional to the intensity of the vibrations. The degree of fibration and the duration of treatment can be set within desired limits by measuring certain properties of the treated fibrils as described below.

Fibrils treated with polyvinyl alcohol solution, when analyzed, are found to have polyvinyl alcohol associated therewith. Thus, the fibrils sorb polyvinyl alcohol by some mechanism that has not yet been established. The quantity of polyvinyl alcohol sorbed can be measured by infrared analysis of a transparent film prepared from the treated fibrils. It is desirable to conduct the treatment under conditions such that the fibrils sorb at least 2 weight % and preferably at lease 8 weight % of polyvinyl alcohol. The melt index of the treated fibrils is lower by the polyvinyl alcohol associated therewith. Thus, the lowering of melt index can be used as a second measure of quantity of polyvinyl alcohol absorbed by the fibrils. This parameter may be of limited value when the melt index of the fibril polymer is unusually low.

The fibrils treated by the method of the invention can be any olefin polymer. Treated fibrils of optimum properties are obtained, however, when the fibril is prepared from an ethylene or propylene polymer having a weight average molecular weight of at least about 1 million and preferably at least about 1.5 million. Such polymers will have an intrinsic viscosity of at least 3.5, preferably at least 5.0, and most especially at least 10.0. A listing of suitable olefin polymers and olefin polymer mixtures is set forth in U.S. Pat. No. 4,013,751, which description is incorporated herein by reference.

The following examples are set forth to illustrate more clearly the principle and practice of the invention to those skilled in the art. Where parts or percentages are set forth, they are parts or percentages on a weight basis unless otherwise noted.

EXAMPLE 1

A lot of fibrils were prepared following the procedure of Example 1 of U.S. Pat. No. 4,013,751. The ethylene polymer from which the fibrils were prepared had a weight average molecular weight of about 1,500,000. The hydrocarbon-wet fibrils were refined two times for 120 seconds in a Waring Blendor employing 100 parts of 91% isopropanol per part of fibrils. The fibrils were filtered and pressed to expel the maximum quantity of isopropanol.

Ten grams of the fibrils and 650 grams of water were stirred for 15 seconds in a Waring Blendor to prepare a fine dispersion of fibrils in the water. This slurry and an additional 350 ml of water having 1 gram of polyvinyl alcohol (Vinol 540) dissolved therein were transferred to a 2-liter beaker equipped with a magnetic stirrer. An ultrasonic probe (Sonifier Model S-125 supplied by Branson Sonic Power) was placed in the slurry and operated at 10 amps. (dc output) of power. Stirring was continued for 15 minutes. The fibrils were filtered, washed with water, refiltered and dried for sixteen hours at 120° C.

A first control A was prepared in the same manner, except that the ultrasonic probe was not used. A second control B was prepared by stirring 10 grams of fibrils with 1,000 ml of water containing 1 gram of polyvinyl alcohol for 60 seconds in a Waring Blendor. Previous experience has shown that stirring these fibrils for more than 1 minute in the Waring Blendor degrades the fibrils.

Films were pressed from the product of this example and both of the controls. The polyvinyl alcohol content was measured by I.R. analysis with the results being shown in Table I.

Table I

| Sample | % Polyvinyl Alcohol |
|---|---|
| Control A | 5% |
| Control B | 4% |
| Example 1 | 9% |

From the above data, it is apparent that the process of the invention gives close to a quantitative sorption of the polyvinyl alcohol.

The high load melt index of the ethylene polymer employed in the experiments, and the fibrils prepared in this example and Controls A and B were measured. The results are shown in Table II.

Table II

| Sample | High Load Melt Index |
|---|---|
| Starting Polymer | 0.0079 |
| Control A | 0.0094 |
| Control B | 0.0109 |
| Example 1 | 0.0044 |

Neither of controls A or B lowered the melt index of the starting polymer, whereas the product of the invention reduced the melt index by nearly 50%, i.e., 0.0079 - 0.0044/0.0079 × 100.

Waterlaid sheets were prepared from the product of the example and controls A and B. By hand tear tests, the product of the example gave significantly stronger sheets than either of the controls.

EXAMPLE 2

Part A

A lot of fibrils was prepared following the procedure of Example 1 of U.S. Pat. No. 4,013,751. The ethylene polymer from which the fibrils were prepared was the same ethylene polymer employed in Example 1. The hydrocarbon wet fibrils were refined two times for 120 seconds each in a 2-gallon Waring Blendor employing 85 parts of 98% IPA per part of fibrils, with the remainder being the liquid adhering to the fibrils. After each wash the fibrils were filtered and pressed to expel the maximum quantity of IPA. After the second wash, 98% IPA was added to the filter cake to adjust the solids to 10%.

Part B

An aliquot of the fibrils of Part A was treated with polyvinyl alcohol by the procedure of U.S. Pat. No. 4,049,493. The filter cake of Part A in the amount of 150 grams was added to a Waring Blendor which contained 1.5 grams of PVA dissolved in 1349 grams of water. The solution then was refined for two minutes at high speed. The fibrils then were filtered and washed with water in the Waring Blendor and filtered again. The resulting cake was redispersed using the Waring Blendor for 30 seconds at low speed with the fibril concentration being 1%. This dispersion then was used to make handsheets using a Noble-Wood sheet machine. These sheets are designated as Control A.

Part C

A second aliquot of the filter cake of Part A was thoroughly dispersed in 1349 grams of water having 1.5 grams of polyvinyl alcohol dissolved therein. This dispersion was prepared by stirring for 30 seconds in a Waring Blendor at low speed. This dispersion then was permitted to stand for 30 minutes for the fibrils to sorb polyvinyl alcohol. Hand sheets were prepared from this dispersion and are designated as Control B.

Part D Part C was repeated except that the aqueous dispersion was subjected to ultrasonic vibrations for 15 minutes employing the ultrasonic probe and operating conditions set forth in Example 1. Hand sheets were prepared from this dispersion.

The properties of the hand sheet are set forth in Table III. All properties were measured by TAPPI procedures and all values were divided by the sheets basis weight to obtain factored values.

Table III

| Sample Designation | Control A | Control B | Product of Invention |
|---|---|---|---|
| Basis weight | 65.4 | 59.4 | 64.4 |
| Break length, km | 4.9 | 3.4 | 4.8 |
| Mullen Burst strength, psi | 48 | 31 | 44 |
| Tear strength, g/sheet | 137 | 115 | 133 |
| Elongation, % | 87.9 | 66 | 94.6 |
| Tensile energy absorption, ft-lbs/ft$^2$ | 136 | 71.8 | 141 |
| Tensile strength, lbs/inch | 17.9 | 11.4 | 17.3 |
| Yield strength at 5% Elongation, lbs/inch | 9.3 | 7.6 | 9.1 |

A comparison of the results of Control B with the product of the invention establishes that the use of ultrasonic vibrations enhances the quality of the fibrils and the waterlaid sheets prepared therefrom.

A comparison of the results of Control A and the product of the invention demonstrates that fibrils of equivalent properties can be obtained without use of the high shear mixing developed in a Waring Blendor. This observation is important for two reasons. First, the quantity of energy required in the present invention is significantly less than required by the process of U.S. Pat. No. 4,049,493. Second, it is difficult and expensive to manufacture commercial size equipment which provides a shear-intensive mixing action equivalent to that obtained in laboratory size Waring Blendors.

What is claimed is:

1. In a process in which high molecular weight olefin polymer fibrils are prepared by precipitation from a hydrocarbon medium, refined in the presence of an organic liquid miscible with both hydrocarbons and water, and subsequently slurried in the presence of an aqueous solution of polyvinyl alcohol; the improvement which comprises slurrying said fibrils in the presence of said aqueous polyvinyl alcohol solution while subjecting said solution to ultrasonic vibrations.

2. The process of claim 1 in which the polyvinyl alcohol employed is present in the amount of about 1 to 10 parts per 100 parts of fibrils.

3. The process of claim 2 in which the refining is continued until the fibrils have sorbed at least about 2 weight % of polyvinyl alcohol.

4. The process of any of claims 1, 2, or 3 in which the fibrils are prepared from an ethylene polymer having a weight average molecular weight of at least about one million.

* * * * *